US007798909B2

(12) United States Patent
Giroux

(10) Patent No.: US 7,798,909 B2
(45) Date of Patent: Sep. 21, 2010

(54) POOL TABLE

(76) Inventor: Clément Giroux, 5565 Route 112, Ascot Corner, Quebec (CA) J0B 1A0

( * ) Notice: Subject to any disclaimer, the term of this patent is extended or adjusted under 35 U.S.C. 154(b) by 116 days.

(21) Appl. No.: 11/710,107

(22) Filed: Feb. 23, 2007

(65) Prior Publication Data

US 2007/0219007 A1 Sep. 20, 2007

Related U.S. Application Data

(63) Continuation-in-part of application No. 10/991,700, filed on Nov. 18, 2004, now abandoned.

(30) Foreign Application Priority Data

Nov. 26, 2003 (CA) ..... 2450952

(51) Int. Cl.
*A63D 15/00* (2006.01)
*A63D 15/20* (2006.01)

(52) U.S. Cl. ..... 473/4; 473/17; 473/20

(58) Field of Classification Search ..... 473/20, 473/18, 22, 14, 17, 19, 1, 3, 4, 6–10; 27/123 R, 27/122 R, 125 R
See application file for complete search history.

(56) References Cited

U.S. PATENT DOCUMENTS 110,925 A * 1/1871 Lochhead ..... 473/20
157,737 A * 12/1874 Cook ..... 473/20
158,655 A * 1/1875 Wainwright ..... 273/118 D
242,054 A * 5/1881 Sause ..... 473/18
574,351 A * 12/1896 Conner ..... 273/123 R
636,257 A * 11/1899 Gibbon et al. ..... 473/20
688,027 A * 12/1901 Moyer ..... 473/22
736,938 A * 8/1903 Clark ..... 273/123 R
828,211 A * 8/1906 Johnson ..... 273/123 R
1,206,194 A * 11/1916 Becker et al. ..... 273/118 R
1,221,181 A * 4/1917 Hooper ..... 273/317.2
1,430,838 A * 10/1922 Olson ..... 273/118 R
1,813,116 A * 7/1931 Clausen ..... 473/20
1,875,198 A * 8/1932 Nagai ..... 473/20
1,934,502 A * 11/1933 Husted ..... 473/20
2,010,282 A * 8/1935 Wanncmacher ..... 473/2
2,310,163 A * 2/1943 Moxey ..... 340/323 R
2,450,613 A * 10/1948 Radinsky ..... 273/122 R
3,360,265 A * 12/1967 Yabroudy ..... 273/108.21
3,711,099 A * 1/1973 Milu ..... 273/123 R
3,857,567 A * 12/1974 Goldfarb et al. ..... 273/123 A
3,868,111 A * 2/1975 Schuelke ..... 273/108.21
3,931,974 A * 1/1976 Goldfarb et al. ..... 273/126 R
4,039,191 A * 8/1977 Breslow ..... 273/125 R
4,098,507 A * 7/1978 Hudon ..... 273/108.21
4,147,347 A * 4/1979 Angove ..... 273/127 B
4,190,250 A * 2/1980 Grifhorst ..... 273/342

(Continued)

FOREIGN PATENT DOCUMENTS

EP 879623 A2 * 11/1998

*Primary Examiner*—Mitra Aryanpour
(74) *Attorney, Agent, or Firm*—Eric Fincham

(57) ABSTRACT

A pool table which comprises a planar playing surface and having conventional indent sidewalls and pockets associated therewith, the improvement wherein there is provided a center cushion which is located substantially centrally of the playing surface. Preferably, the center cushion partially surrounds a centrally located pocket.

3 Claims, 4 Drawing Sheets

U.S. PATENT DOCUMENTS 4,240,634 A * 12/1980 Wiczer ..... 273/127 R
4,268,033 A * 5/1981 Fontaine ..... 473/2
4,318,543 A * 3/1982 Vollendorf ..... 473/7
4,431,186 A * 2/1984 Gold ..... 473/18
4,460,176 A * 7/1984 Peters ..... 273/127 C
4,461,476 A * 7/1984 Tudek ..... 473/7
4,531,739 A * 7/1985 Dunn et al. ..... 273/127 C
6,513,807 B1 * 2/2003 Lynch ..... 273/119 R
6,827,651 B1 * 12/2004 Davis ..... 473/2

* cited by examiner

POOL TABLE

This application is a Continuation-In-Part of application Ser. No. 10/991,700 filed Nov. 18, 2064 now abandoned.

FIELD OF THE INVENTION

The present invention relates to a pool table and more particularly, relates to a novel structure for a pool table.

BACKGROUND OF THE INVENTION

The use of pool tables is well established in the art. In this respect, the term "pool table" generally denotes a table having a flat planar surface with side cushions and a plurality of pockets into which balls are shot. As used in here, the term "pool table" includes what are also referred to as billiard tables and snooker tables, all of which are of a similar structure.

The game of pool, as aforementioned, is well known and extremely popular. Whether the games be pool, snooker, billiards, or a variation thereof, the game usually consists of using a cue to hit a cue ball which in turn will hit one or more balls on the table. The traditional arrangement for all such games has consisted of four corner pockets, one at each corner of the rectangular table and a pair of side pockets.

There has also been proposed in the art certain variations of pool tables to enable them to be utilized for other games. Thus, as shown in U.S. Pat. No. 4,948,128, there is provided a pool table which is designed to allow various poker games to be played by utilizing card values which are marked on the balls. The Patentee teaches the use of a pool table having enlarged ends and having ten different pockets.

A pool table of a similar configuration is shown in U.S. Pat. No. 5,765,828 and wherein the central area is designed to simulate a golf hole. Thus, each table has a planar surface with raised peripheral side edges with both resilient and non resilient cushions. In this instance, there is only provided a single pocket.

A still further arrangement is disclosed in U.S. Pat. No. 4,461,476 wherein a substantially conventional pool or billiard table is utilized but with the addition of a central pocket. The pockets are each provided with sliding horizontal trap doors and the pool table may be used for games such as golf as well as conventional pool or billiards games.

Notwithstanding the above proposals, the games of pool and billiards have recently become less popular. This loss of popularity is possibly due to the game not evolving over the years.

SUMMARY OF THE INVENTION

It is an object of the present invention to provide a novel pool table which can be utilized in a different manner to provide variations of the game of pool or billiards.

It is a further object of the present invention to provide a pool table which provides greater visual stimulation and attracts attention.

According to one aspect of the present invention, there is provided a pool table comprising a planar playing surface, first and second end walls and first and second sidewalls surrounding the playing surface, each of the first and second sidewalls and end walls having cushions thereon, pockets located at corners where the sidewalls and end walls meet, a center cushion located substantially centrally of the playing surface.

As previously mentioned, the term "pool table" is used herein in a general fashion and is meant to encompass similar tables such as billiard tables and the like. Generally, such tables come in standard sizes having a width of four feet, four and a half or five feet, with the length being twice the width. Usually, pockets are provided at the four corners with an additional pocket being located along each sidewall substantially midway between the ends of the sidewalls.

The pockets vary in structure according to the manufacture of the table and the end use of the same. Thus, most pockets for the residential marketplace will comprise a sack into which the balls will drop. Commercial pool tables, on the other hand, usually allow the balls to return through a channel underneath the table to a central location. It suffices to say that the present invention can be utilized with any of the above configurations.

The cloth used for the surface and the structure of the cushions along the side and end walls is again well known in the art and need not be detailed herein.

In one embodiment of the present invention, there is provided an additional pocket which is located centrally of the table surface. In other words, the center pocket would be aligned with the two side pockets.

The center pocket is partially surrounded by at least one cushion and preferably two cushions to provide a symmetrical aspect. Between the two cushions, there is provided a passageway to which access may be had to the center pocket. Preferably, the center pocket has an arcuate generally elliptical cushion structure on the exteriorly facing side thereof while the internally facing side is substantially flat. With such an arrangement, the game becomes substantially more difficult as any ball banked off the arcuate cushion will rebound at an angle which depends on the tangential line at the point of contact. Thus, a difference of an inch will make a substantial difference in the rebound path of a ball striking the cushion. The cushions surrounding the center pocket are formed of a material similar or identical to that forming the cushions of the table—i.e. the material may be a resilient rubber to provide a proper rebound. In a preferred embodiment, the cushions taken together have an elliptical outline.

In one aspect of the present invention, it would be possible to eliminate the central pocket and merely provide a cushion structure centrally located on the table.

In a further aspect of the present invention, the table is provided with visual indicators to call attention to the achievement of certain goals. In one such arrangement, a plurality of lights may be provided about the periphery of the table, with the lights flashing once a ball has entered one of the pockets. The provision of suitable contacts and control means for achieving the same are well known in the art and need not be detailed herein.

In a further embodiment, the central pocket may be provided with a cover structure over the cushion and which would incorporate flashing lights. These lights can be activated through the use of sensors when a ball enters the center pocket.

The lights may be any suitable such as are well known in the art. To this end, fluorescent lights and/or LED's are preferred.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
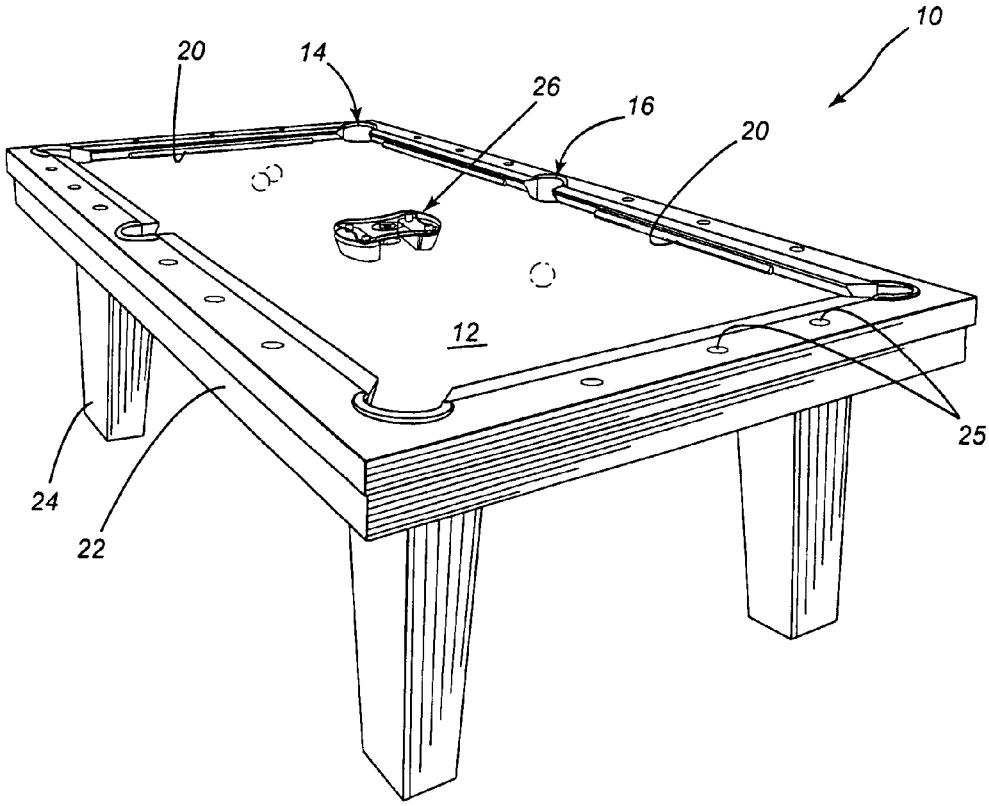
FIG. 1 is a perspective view of a pool table according to an embodiment of the present invention.
Figure 2:
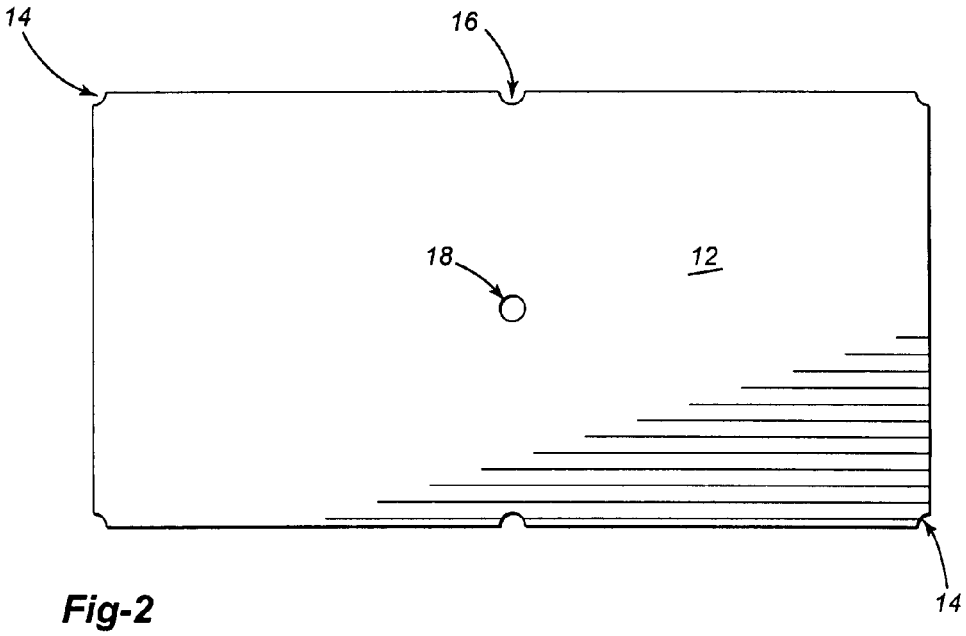
FIG. 2 is a top plan view of the table surface thereof.
Figure 3:
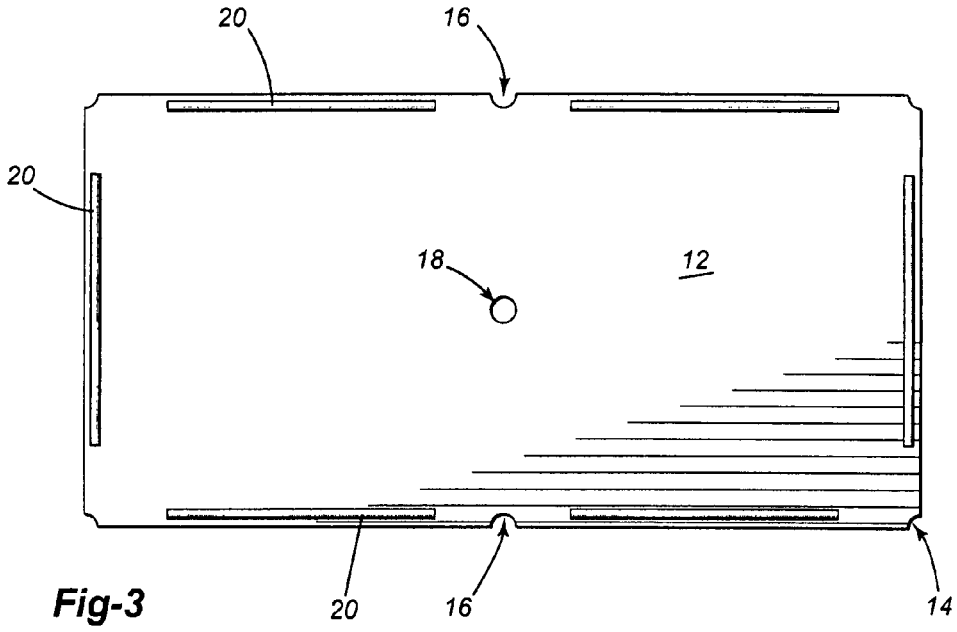
FIG. 3 is a top plan view of the table surface showing the use of lighting elements.

Referring to the drawings in a greater detail and by reference characters thereto, there is illustrated in FIG. 1 a pool table which is generally designated by reference numeral 10.

Pool table 10 includes a table portion 12 which is of a rectangular configuration and generally measures either 4 feet by 8 feet, 5 feet by 10 feet, or 6 feet by 12 feet. Table 12 is flat as is conventional. There are provided cutouts which form corner pockets 14 and a pair of side pockets 16. According to the present invention, there is also provided a center pocket 18 which comprises an aperture located midway between the sides and midway between the ends.

In a preferred embodiment of the present invention, there are provided lights 20 along the sides and ends of the table.

Table portion 12, in a conventional manner, is mounted on a base 22 which is supported by legs 24.

Surrounding center pocket 18 is a center cushion member generally designated by reference numeral 26. Center cushion member 26 is comprised of a first cushion element 28 and a second cushion element 28'. Cushion elements 28, 28' are secured together by connecting member 30.

Figure 4:
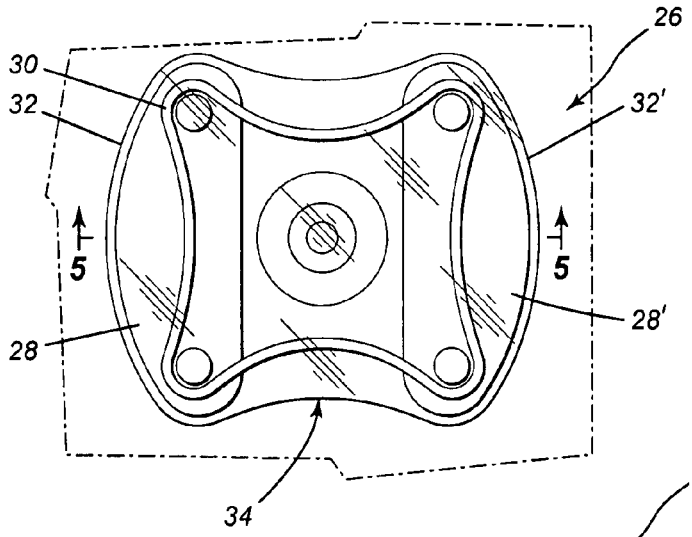
FIG. 4 is a top plan view of the central cushion member.
Figure 5:
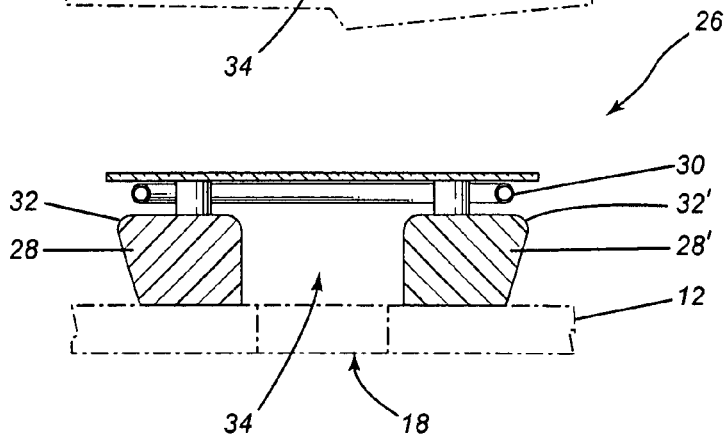
FIG. 5 is a cross sectional view of the cushion member.

As may be seen in FIGS. 1 and 4, each of cushion elements 28, 28' have an arcuate side surface 32, 32' respectively. There is provided a center passage 34 between elements 28, 28' to permit passage of a ball therethrough.

Thus, as may be seen in FIG. 1, the game will become substantially different with the provision of center cushion member 26. In playing the game, one must take into account the arcuate cushion sides 32, 32'. Also, the center pocket 18 can be used in a number of different manners. For example, in one embodiment, it is only the 8 ball which can be sunk in the center pocket 18. However, it may be understood that any number of different rules may be arranged for the novel structure of the instant pool table.

Figure 6:
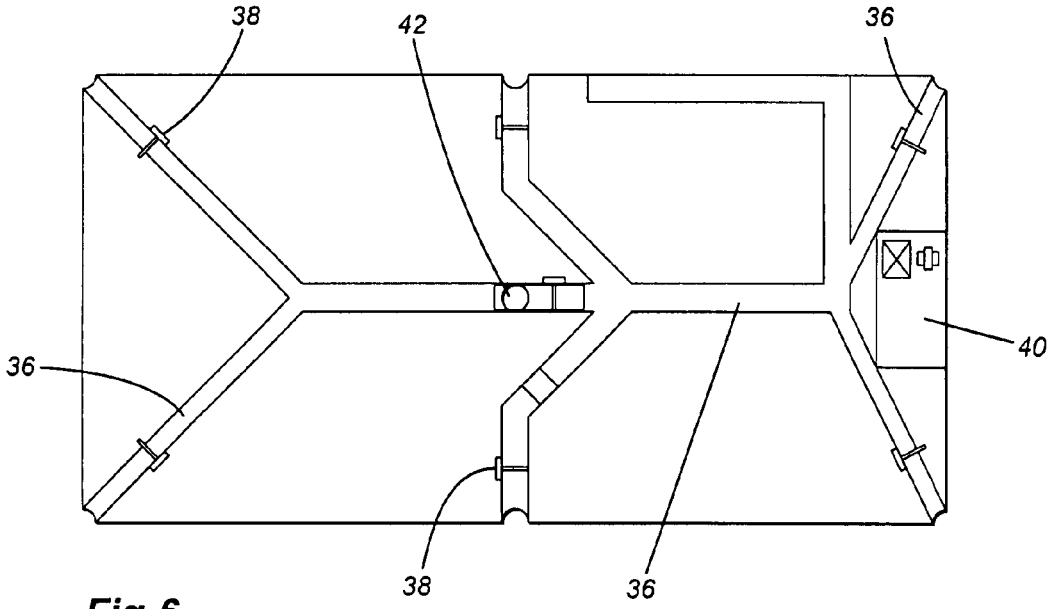
FIG. 6 is a view of the underside of the pool table.

In one embodiment, as may be seen in FIG. 6, the underside of the table is provided with a plurality of ball return passages 36. Each ball return passage has an associated micro switch 38 which is operatively connected to a control box 40. In turn, lights 20 are connected thereto such that when a ball activates a micro switch, the lights 20 may be activated. Located centrally is a counterweight 42.

Apart from the use of lights with contact sensors, one may utilize other visual effects. Thus, for example, there could be a smoke generating means or like devices.

In one particularly preferred embodiment, the table is provided with lights 25 mounted proximate the band of the table. Lights 25 are preferably colored and may be arranged so as to represent the different colored balls. They may be designed to flash sequentially or all at once. As an alternative, the lights may be placed under the cushions of the table. It is particularly preferred that the lights be positioned at the three points between the pockets to indicate the shooting angles.

Figure 7:
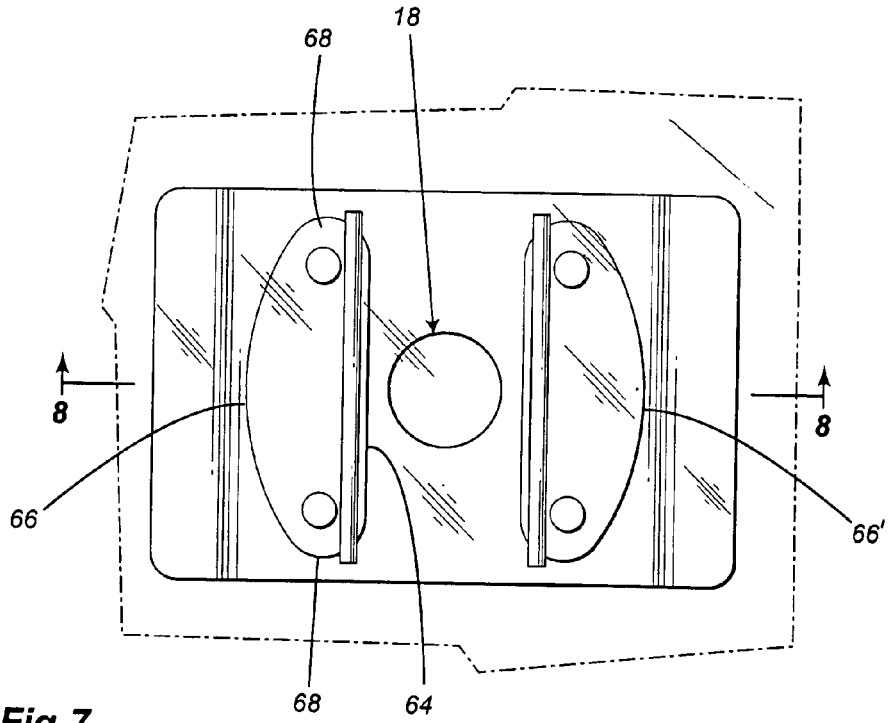
FIG. 7 is a top plan view of an alternative central cushion according to an embodiment of the present invention.
Figure 8:
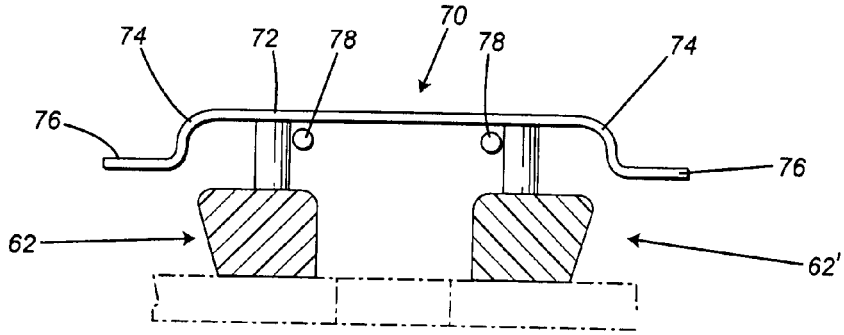
FIG. 8 is a sectional view taken along the lines 8-8 of FIG. 7.

In the embodiments of FIGS. 7 and 8, there is illustrated a modified central cushion structure which comprises two half cushions 62, 62' and wherein each half cushion is a substantial mirror image of the other. As may be seen in FIG. 7, half cushion 62 is provided with a substantially straight outline adjacent central pocket 18 while on in the other side, there is provided an arcuate sidewall 66 which joins straight section 64 through curved half cushion section 68.

There is provided a top cover 70 which comprises a planar upper portion 72 with downwardly extending side portions 74 and terminating in substantially horizontal portions 76. A pair of lights 78 are provided.

It will be understood that the above described embodiment is for purposes of illustration only and that changes or modifications may be made thereto without departing from the spirit and scope of the invention.

I claim:

1. An apparatus for use in combination with a pool table, said pool table comprising:

two side walls and two end walls;

a planar rectangular playing surface;

each of said sidewalls and end walls having cushions thereon;

corner pockets located at corners where said sidewalls and end walls meet;

first and second side pockets located in said first and second side walls respectively; and a center pocket; and a center cushion structure located substantially centrally of said playing surface, said center cushion comprising first and second spaced apart half cushions, each half cushion being a mirror image of the other, a passageway extending between said first and second half cushions;

said single center cushion structure having a pair of arcuate shaped outer walls; and said single center pocket is partially surrounded by said center cushion structure while permitting access to said center pocket by a playing ball; and a cover member extending over said center pocket, said cover member being secured to said first and second half cushions.

2. The pool table of claim 1 wherein said passageway extends parallel to said sidewalls.

3. The pool table of claim 1 further including light means associated with said center cushion, sensor means associated with said center pocket to sense the entry of a ball therein, and control means to cause said light means to flash when said sensor means detect a ball.

* * * * *